US005276481A

United States Patent [19]

Kinoshita et al.

[11] Patent Number: 5,276,481

[45] Date of Patent: Jan. 4, 1994

[54] METHOD AND APPARATUS FOR OPTICALLY MEASURING TONER DENSITY

[75] Inventors: Naoyoshi Kinoshita, Aichi; Kouichi Etou, Toyokawa, both of Japan

[73] Assignee: Minolta Camera Kabushiki Kaisha, Osaka, Japan

[21] Appl. No.: 882,617

[22] Filed: May 13, 1992

[30] Foreign Application Priority Data

May 14, 1991 [JP] Japan ..... 3-109037

[51] Int. Cl.[5] ..... G03G 15/00

[52] U.S. Cl. ..... 355/206; 118/691; 355/246

[58] Field of Search ..... 118/691; 355/246, 205, 355/206, 208

[56] References Cited

U.S. PATENT DOCUMENTS

| | | | |
|---|---|---|---|
| 4,419,960 | 12/1983 | Okamura et al. | 118/691 X |
| 4,431,300 | 2/1984 | Snelling | 355/246 |
| 4,536,080 | 8/1985 | Hauser | 118/691 X |
| 4,550,998 | 11/1985 | Nishikawa | 355/246 |
| 4,551,002 | 11/1985 | Aoki et al. | 118/691 X |
| 4,648,702 | 3/1987 | Goto | 118/691 X |
| 4,801,980 | 1/1989 | Arai et al. | 355/246 |
| 5,111,247 | 5/1992 | Nichols | 355/246 |
| 5,117,259 | 5/1992 | Etou et al. | 355/246 X |
| 5,146,274 | 9/1992 | Hattori et al. | 118/691 X |

FOREIGN PATENT DOCUMENTS

| | | |
|---|---|---|
| 60-80879 | 5/1985 | Japan . |
| 60-159872 | 8/1985 | Japan . |
| 60-220374 | 11/1985 | Japan . |
| 61-212868 | 9/1986 | Japan . |
| 63-177173 | 7/1988 | Japan . |

*Primary Examiner*—Joan H. Pendegrass
*Assistant Examiner*—Robert Beatty
*Attorney, Agent, or Firm*—Willian Brinks Olds Hofer Gilson & Lione

[57] ABSTRACT

An apparatus for optically measuring toner density, having a rotary member which rotates and retains a developer constituted by a toner and a carrier by magnetic force, a transparent detection window which is disposed at a position where the developer retained on the rotary member rubs said detection window through rotation of said rotary member, a detection device which illuminates the developer through the detection window and detects the amount of reflected light from the developer and the magnitude of variations of the amount in response to rotation of the rotary member, and a warning device which issues an abnormal warning when the magnitude is smaller than a predetermined reference value, and a method for optically measuring toner density by using the apparatus.

12 Claims, 15 Drawing Sheets

METHOD AND APPARATUS FOR OPTICALLY MEASURING TONER DENSITY

FIELD OF THE INVENTION

The present invention relates to a method and an apparatus for optically measuring toner density in a two-component powder developer constituted by a toner and a carrier by using an optical means.

BACKGROUND OF THE INVENTION

In an image forming device which uses a two-component powder developer constituted by a toner and a carrier, it is required to supply the toner to the developer on the basis of a result of detection of weight-mixture ratio of the toner to the carrier (hereinafter, referred to as "toner density"), so as to keep constant density of an image by compensating the toner consumed by image formation.

Therefore, conventionally, in a known method for measuring the toner density, the toner density in the developer is measured on the basis of amount of reflected light from the developer which is constrained by magnetic field, and which is illuminated through a transparent detection window (hereinafter, this method is referred to as "optical detection method"). Further, it is proposed as a kind of the optical detection method to make the transparent detection window and the toner electrically repulsive with each other by applying window bias having a polarity identical with that of the charged toner to the transparent detection window in order to prevent the toner from adhering to the detection window.

However, the charging amount in the developer varies with humidity and deterioration degree of the developer. More specifically, the charging amount decreases when the developer becomes wet on account of rise of humidity. On the other hand, the charging amount increases when the developer becomes dry on account of drop of the humidity. Further, the charging amount decreases with the deterioration of the developer caused by agitation etc., while the charging amount increases when the developer is not affected by the agitation etc., and when the developer is fresh.

When the charging amount decreases, attraction force between the carrier and the toner becomes weak, so that they separate from each other. In this case, the carrier does not adhere to the detection window because it is constrained by the magnetic field. However, the toner separating from the carrier is suspended, and this suspended toner adheres to the detection window because the charging amount of the toner is small and electrical repulsive force between the toner and the window bias is weak. On the other hand, in the case that the charging amount of the carrier becomes large, the toner does not adhere to the detection window because the repulsive force between the toner and the window bias becomes strong, whereas the carrier is released from the constraint of the magnetic field and adheres to the detection window because the electrical attraction force between the carrier and the window bias becomes stronger than the constraint force of the magnetic field.

In the case that when the toner adheres to the detection window, it is judged that the density of the toner is higher than reference density to be compared because the amount of the reflected light from the developer increases. Therefore, there arises a problem that the density of the image drops because the toner is not replenished in spite of dropping of real toner density. On the other hand, in the case that the carrier adheres to the detection window, it is judged that the toner density is lower than the reference density because the amount of the reflected light from the developer decreases. Therefore, there arises a problem that the developer overflows from a development apparatus resulting in contamination of the interior of an image forming machine because the toner is replenished excessively in spite of required toner density being actually maintained.

SUMMARY OF THE INVENTION

Accordingly, an essential object of the present invention is to provide a method and an apparatus for measuring toner density by using an optical means in a development apparatus, which eliminate the above described disadvantages inherent in the conventional apparatuses.

In accomplishing these and other objects, according to one preferred embodiment of the invention, there is provided a method for optically measuring toner density in two-component developer, comprising the steps of: causing the developer constrained by magnetic field to be brought periodically into contact with a transparent detection window; illuminating the developer through the detection window; measuring the toner density on the basis of amount of reflected light from the developer; and recognizing and warning of an occurrence of abnormality on the detection window when a magnitude of variation of an amount of the reflected light becomes smaller than a predetermined reference value.

The above-described method is carried out by using an apparatus for optically measuring toner density, comprising: a rotary member which rotates and retains a developer constituted by a toner and a carrier by magnetic force; a transparent detection window which is disposed at a position where the developer retained on the rotary member rubs said detection window through rotation of said rotary member; a detection means which illuminates the developer through the detection window and detects an amount of reflected light from the developer and a magnitude of variation of the amount in response to rotation of the rotary member; and a warning means which issues an abnormal warning when the magnitude is smaller than a predetermined reference value.

If the toner or the carrier adheres to the detection window, the magnitude of variation of the amount of the reflected light becomes small corresponding to amount of the adhesion, so that the amount of the reflected light converges to a fixed value. Because, as can be understood, if the detection window is covered completely by the toner or the carrier, the amount of the reflected light becomes a fixed value. Therefore, in the method and apparatus according to the present invention, if the toner or the carrier adheres to the detection window, the magnitude of variation of the amount of the reflected light is reduced such that convergence of the amount of the reflected light to a fixed value is detected. As a result, an abnormal state that the toner or the carrier adheres to the detection window is recognized and warned.

Further, by another embodiment of the present invention, under a condition that the carrier is apt to adhere to the detection window due to increase of the charging amount of the developer caused by drop of humidity or supplying fresh developer to the development apparatus, electrical attraction force between the carrier and the detection window becomes weak and thus, the adhesion of the carrier to the detection window is avoided. On the other hand, under a condition that toner in suspension is apt to be produced due to decrease of the charging amount of the developer caused by rise of the humidity or the deterioration of the developer, window bias rises and therefore, the adhesion of the suspended toner to the detection window is avoided.

BRIEF DESCRIPTION OF THE DRAWINGS

These and other objects and features of the present invention will become clear from the following description taken in conjunction with the preferred embodiments thereof with reference to the accompanying drawings, in which.

DETAILED DESCRIPTION OF THE INVENTION

Figure 1:
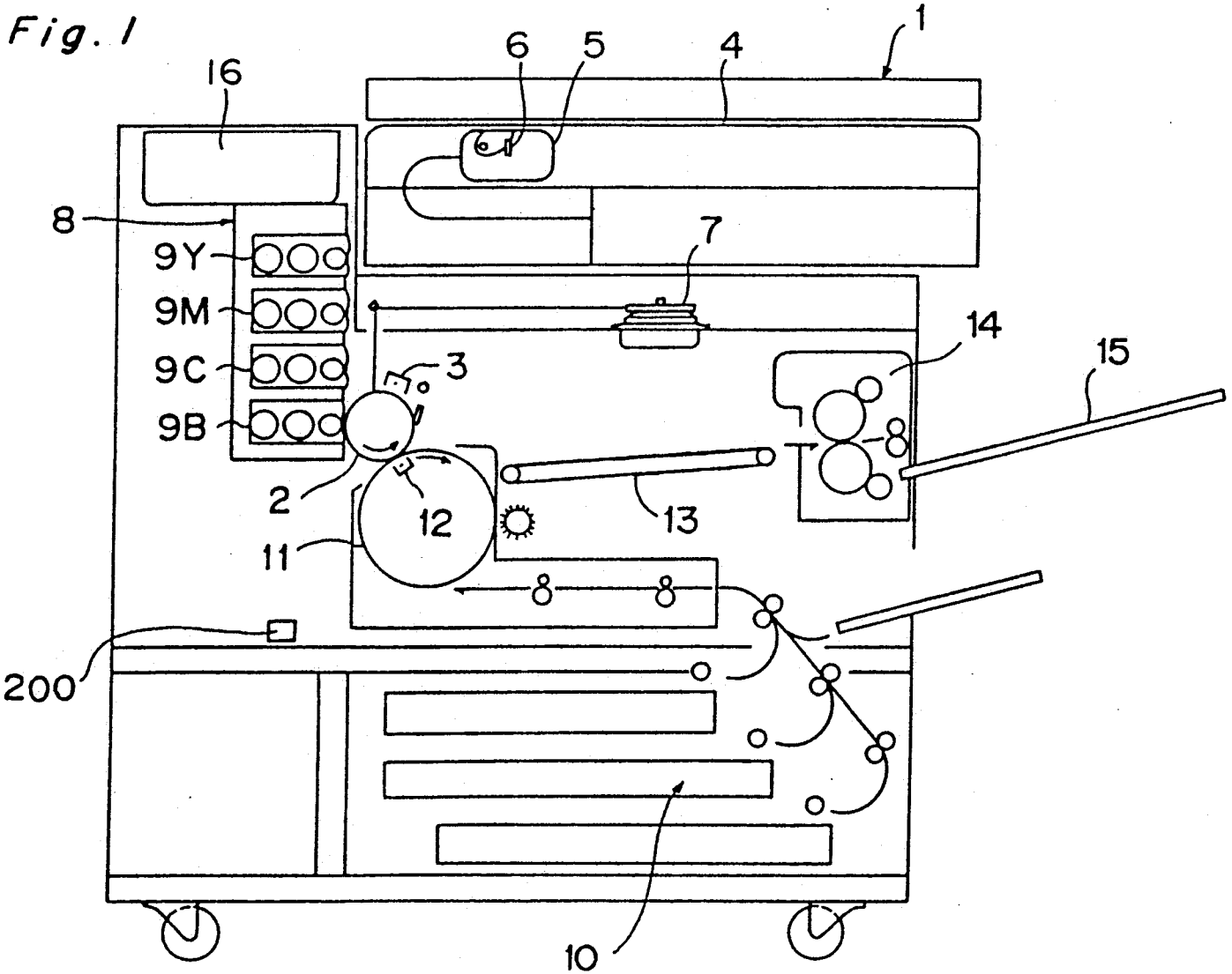
FIG. 1 is a schematic sectional view of a copying machine including a development apparatus in which the present invention is applied.

Before the description of the present invention proceeds, it is to be noted that like parts are designated by like reference numerals throughout the accompanying drawings.

(1) Copying Machine

Figure 6:
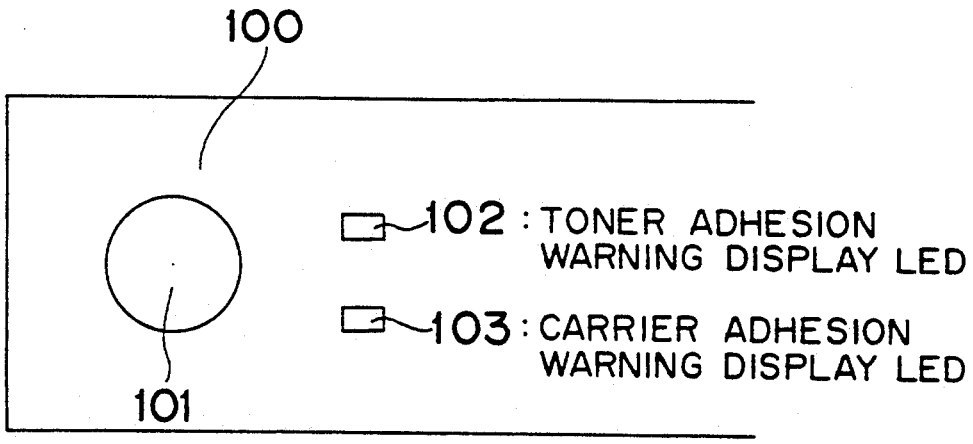
FIG. 6 is a partial plan view of an operation panel used in the development apparatus.

Referring now to the drawings, there is shown in FIG. 1 a full-color copying machine 1 using a electrophotographic method, which includes one preferred embodiment of the present invention. In this copying machine 1, upon depression of a printswitch 101 (See, FIG. 6), a photosensitive drum 2 rotates in the direction of an arrow, and a photosensitive layer of the photosensitive drum 2 is uniformly and electrically charged by a charging device 3. An image reader 5 illuminates an original document (not shown) placed on an original document platform 4, and reflected light from the original document is incident on an optical reader 6 in which pixels of an image of the original document are read as color signals of red, blue and green. These color signals of red, blue and green are converted into binary image signals corresponding to each of a yellow color image, a magenta color image, a cyan color image, or, in addition to these, a black color image of the document by an image processing circuit, and each image signal is input to a laser generator 7. The laser generator 7 illuminates the electrically charged region of the photosensitive drum 2 by a laser beam which is modulated on the basis of the image signals, and forms an electrostatic latent image there corresponding to an image information of each color.

A development unit 8 is provided with a plurality of development apparatuses 9Y, 9M, 9C, 9B. Each of these apparatuses contains a two-component developer constituted by a toner and a carrier, and moves up and down as a whole, so that a selected one of the development apparatuses facing the photosensitive drum 2 visualizes the electrostatic latent image as a toner image of a corresponding color. The development apparatuses 9Y, 9M, 9C, 9B contain, respectively, a toner of yellow(Y), magenta(M), cyan(C) or black (B) color.

A transfer paper sheet is fed from a paper feeder one by one, and wound around a transfer drum 11. On the other hand, the toner image formed in one of the four colors on the photosensitive drum 2 is subsequentially transferred onto a transfer paper sheet through electrical discharge of the transfer apparatus 12 and thus, a full-color toner image is formed on the transfer paper. The transfer paper sheet, on which the full-color toner image is formed, is separated from the transfer drum 11, and transported to a fixing apparatus 14 by a transportation apparatus 13, thereafter the toner image is fixed onto the transfer paper sheet by heating, and the transfer paper sheet is discharged into a discharge tray 15.

(2) Development Apparatus

Figure 2:
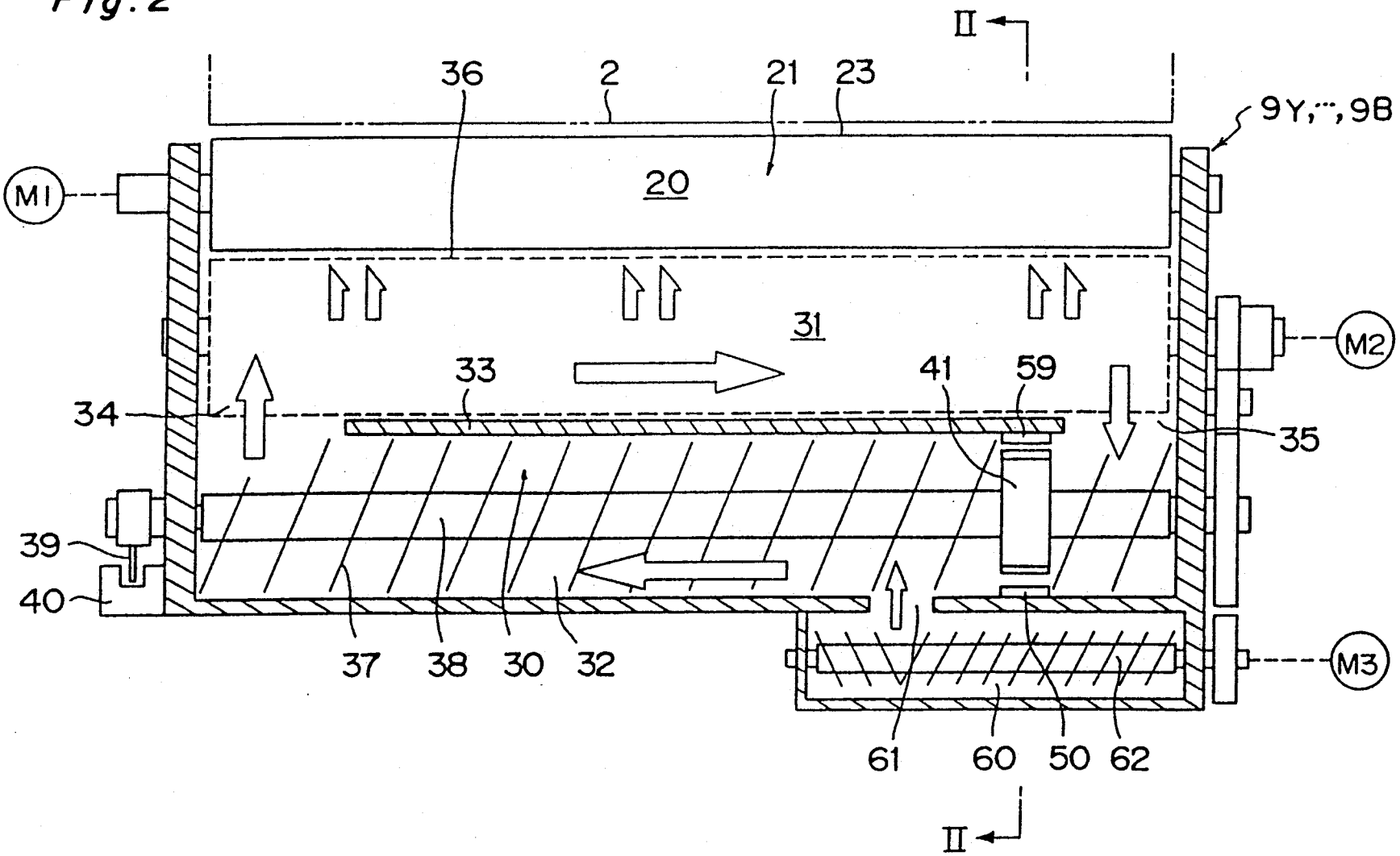
FIG. 2 is a transverse sectional view of a development apparatus shown in FIG. 1.
Figure 3:
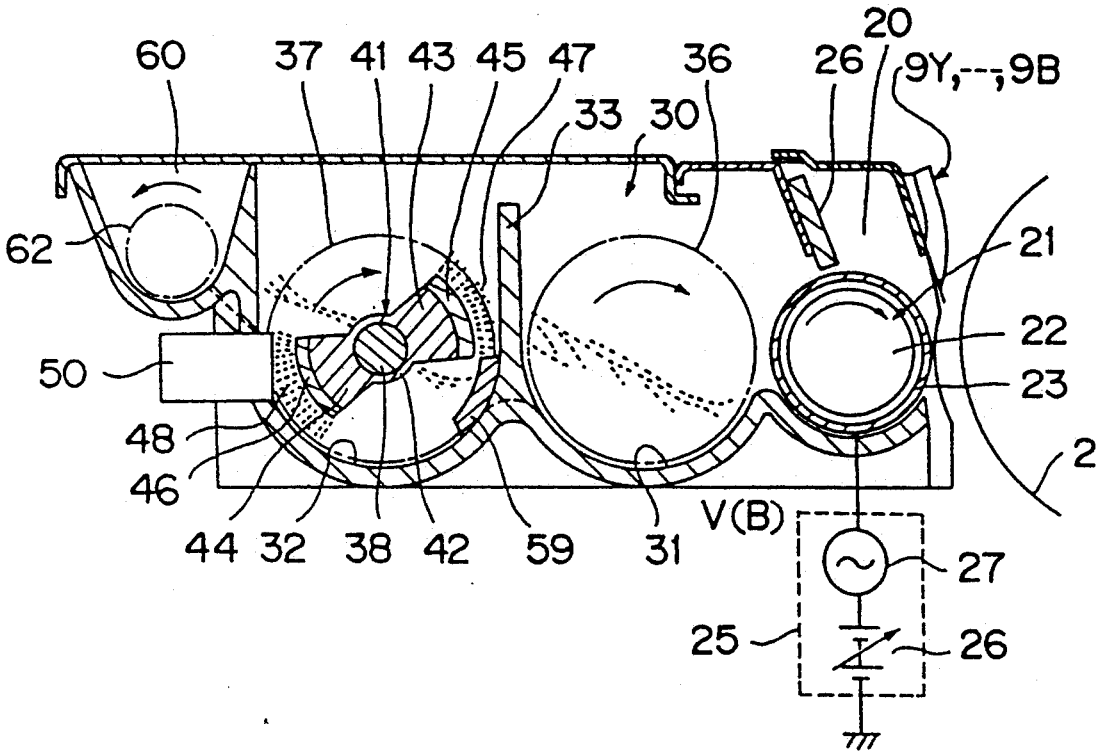
FIG. 3 is a sectional view taken along the line III—III of FIG. 2.

FIGS. 2 and 3 each shows structure of the development apparatuses 9Y, 9M, 9C, 9B.

Since the development apparatuses 9Y, 9M, 9C, 9B have an identical structure, only the development apparatus 9Y is described as for common structure for the sake of brevity, hereinafter.

The development apparatus 9Y is constituted roughly by a development section 20, a developer agitator section 30 hereinafter, referred to as "agitator section 30") and a toner replenishment section 60.

(i) Development Section 20

In the development section 20, a development roller 21 situated facing the photosensitive drum 2 is disposed. Over the surface of the development roller 21, a blade 26 for adjusting a height of magnetic bristles is disposed so as to face this roller 21 with a minute gap. The development roller 21 is comprised with a magnet body 22 fixed non-rotatably, and a sleeve 23 mounted rotatably around the magnet body 22. The sleeve 23 of the development apparatus facing the photosensitive drum 2 is coupled to a development motor M1 such that the sleeve 23 is driven to rotate in a direction of an arrow. Further, in the development apparatus facing the photosensitive drum 2, the sleeve 23 is connected with electric power source 25 in which a DC electric power source 26 and a AC electric power source 27 is connected in series such that a development bias $V_B$ is applied to the sleeve 23.

(ii) Agitator Section 30

In the agitator section 30, first agitator passage 31 and second agitator passage 32 are formed. The first agitator passage 31 is adjacent to the development section 20, and behind it, a second agitator passage 32 is situated. While these first and second agitator passages 31, 32 are separated from each other by a wall 33, they are communicated with each other by respective passages 34, 35 formed by cutting off at opposite end portions of the wall 33.

A bucket roller 36 and a conveying screw 37 are disposed in the first agitator passage 31 and the second agitator passage 32, respectively. Further, the bucket roller 36 and the conveying screw 37 of the development apparatus facing the photosensitive drum 2 are coupled to an agitator motor M2 such that they are driven to rotate in a direction of an arrow.

On the other hand, a magnet retainer 41 is made of a non-magnetic material, and is constituted by a cylindrical main body 42 and two sectorial projections 43, 44 projecting in opposite directions from each other from the main body 42. On outer surfaces of these projections 43, 44, magnets 45, 46 are disposed. The main body 42 is fitted around the shaft 38 such that the magnet retainer 41 is fixed in the vicinity of the right-hand passage 35 in FIG. 2.

Figure 4:
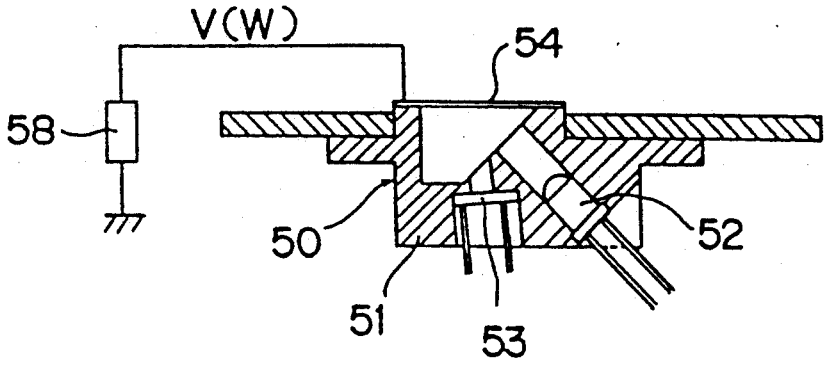
FIG. 4 is a sectional view of a sensor for toner density detection used in the development apparatus.

A sensor 50 for the toner density detection, as shown in FIG. 4 is constituted by a housing 51, a light emitting element 52 and a light receiving element 53 which are fixed to the housing 51, and a transparent detection window 54 covering detection positions of these elements 52, 53. The detection window 54 is disposed in the second agitator passage 32 so as to face the magnet retainer 41. Further, when one of the development apparatus faces the photosensitive drum 2, the detection window 54 of this development apparatus is connected with the window bias electric power source 58 such that the DC window bias $V_W$ having a polarity identical with that of a charged toner is applied to the detection window 54.

A scraper 59 made of non-magnetic plastic, rubber or plastic-film etc. is disposed in the second agitator passage 32 so as to face the magnets 45 and 46 with a minute gap therebetween.

(iii) Toner Replenishment Section 60

The toner replenishment section 60 is disposed at a rear portion of the second agitator passage 32, and is communicated with the second agitator passage 32 through a replenishment opening 61 which is formed in left side of the sensor 50 in FIG. 2. Further, in the toner replenishment section 60, a replenishment screw 62 is disposed, and the replenishment screw 62 of the development apparatus facing the photosensitive drum 2 is coupled to a toner replenishment motor M3 such that the screw 62 is rotated by the motor M3. Further, the toner replenishment section 60 of each development apparatus is coupled to a toner box 16 (See FIG. 1) such that a toner of a corresponding color is replenished to the section 60 from each toner box 16.

(3) Controller Circuit

Figure 5:
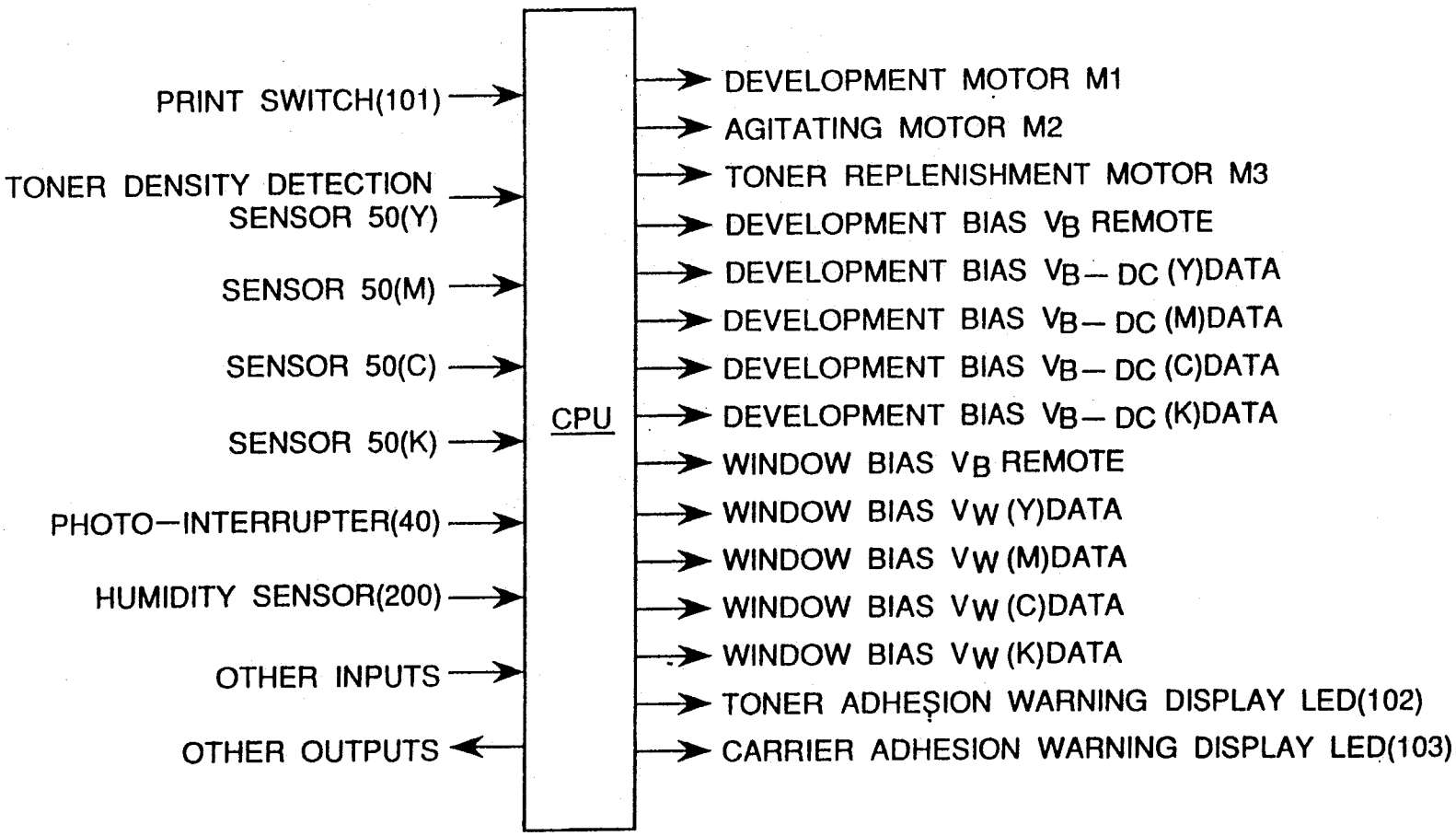
FIG. 5 shows inputs and outputs in CPU used in the development apparatus.

As shown in FIG. 5, which is a block diagram of a controller circuit, signals output from print switch 101 of operation panel 100, sensor 50(Y, M, C, B) of the development apparatus 9(Y, M, C, B), photo-interrupter 40 and humidity sensor 200 (See, FIG. 1) are input to a CPU.

Meanwhile, the humidity sensor 200 may be provided either inside or outside of the copying machine 1.

Further, a drive signal for a development motor M1, an agitator motor M2 and a toner replenishment motor M3, and a remote signal of each of an electrical power source 25 for a development bias and an electrical power source 58 for a window bias, and data of DC development bias $V_{B\text{-}DC}$(Y, M, C, for the development apparatus(Y, M, C, B), and data of DC window bias $V_W$(Y, M, C, B) for the development apparatus(Y, M, C, B), and blink signals to LED 102 and 103 of the operation panel 100 are output from the CPU.

(4) Development Control

Hereinafter, development control by the CPU is described.

In the development apparatuses 9(Y, M, C, B), a developer constituted by a toner and a carrier is contained in the first agitator passage 31 and the second agitator passage 32.

In the development apparatus facing the photosensitive drum 2, the developer in the first agitator 31 is conveyed in the right-ward direction in FIG. 2 with the rotation of the bucket roller 36, and conveyed into the second agitator passage 32 through the right-hand passage 35.

The developer in the second agitator passage 32 is conveyed in the left-ward direction in FIG. 2 with the rotation of the conveying screw 37, and conveyed into the first agitator passage 31 through the left-hand passage 34. In this way, the developer in the agitator passages 31 and 32 is conveyed and circulated through the passages 34, 35, and mixed through its circulation, thereby the toner and the carrier are charged to opposite polarity from each other.

The developer conveyed in the first agitator passage 31 is supplied to the outer surface of the sleeve 23 by the bucket roller 36. The developer supplied to the sleeve 23 is retained by magnetic force of the magnet body 22, and conveyed in the direction of an arrow with the rotation of the sleeve 23. Further, after a height of magnetic bristles of the developer is adjusted by the blade 26, the development is performed by supplying the toner to a electrostatic latent image on the portion of the electrosensitive drum 2 facing the sleeve 23.

In the second agitator passage 32, the developer is retained on the magnets 45 and 46 rotating with the conveying screw 37, and conveyed in the direction of an arrow. The developer retained on the magnets 45 and 46 forms magnetic brushes, which are rubbed against the detection window 54 of the sensor 50 with a rotation of the conveying screw 37 alternately.

The magnetic brushes are scraped off by the scraper 59 after they are rubbed against the detection window 54, thereafter new developer is retained on the magnets 45 and 46. The toner density is measured succeedingly from the developer which is conveyed in left-ward direction in the second agitator passage 32.

The sensor 50 illuminates the developer through the detection window 54 by light emitting element 54, and detects reflected light from the developer by the light receiving element 53. Further, the sensor 50 converts the light detected by the light receiving element 53 into a voltage and outputs the voltage to the CPU.

Figure 7:
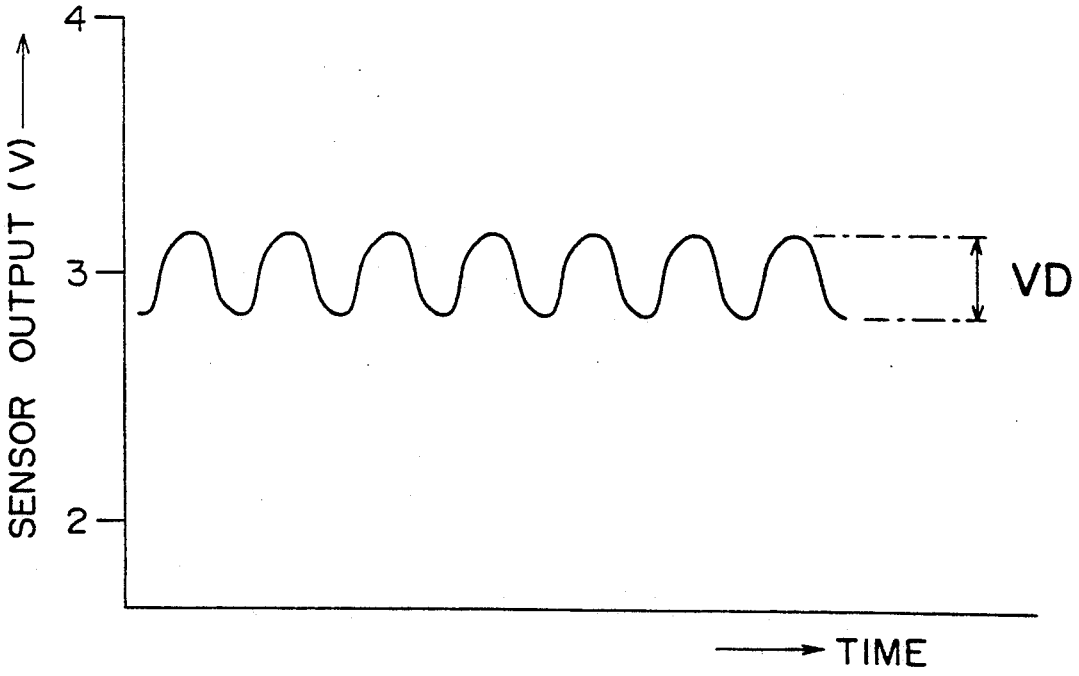
FIG. 7 shows an output from the sensor for toner density detection.

Meanwhile, as shown in FIG. 7, output waveform of the sensor 50 varies with the rotation of the conveying screw 37. Namely, output voltage becomes high when the magnetic brush is in contact with the detection window 54, while the output voltage becomes low when the magnetic brush is not in contact with the detection window 54.

The CPU detects the toner density in the developer based on the voltage output from the sensor 50 when the magnetic brush is in contact with the detection window 54. Because a substantially fixed amount of the developer retained on the magnet 45 or 46 exists between the magnet 45 or 46 and the sensor 50 when the magnet 45 or 46 faces the detection window 50, so that it becomes possible to detect correct toner density independently of the amount of the developer contained in the second agitator passage 32.

Thus, the CPU controls the toner box so as to supply the toner of corresponding color to the toner replenishment section 60 from the toner box when the toner density is lower than the reference density. The supplied toner is replenished to the second agitator passage 32 by the replenishment screw 62, and thus the toner density in the developer is recovered.

Meanwhile, toner density detection may also be performed not only on one development apparatus in a development state, facing the photosensitive drum 2, but on the remaining development apparatus in a non-development state, which are retracted from the photosensitive drum 2. Thus, development can be started immediately by the development apparatus set in development state, so that a time period required for adjusting toner density is reduced by an amount and thus, the image can be obtained earlier by the amount than other procedures.

(5) Toner density control and window bias control etc.

Referring now to the attached flow charts, toner density control and window bias control etc. executed by the CPU are described hereinafter.

Figure 8:
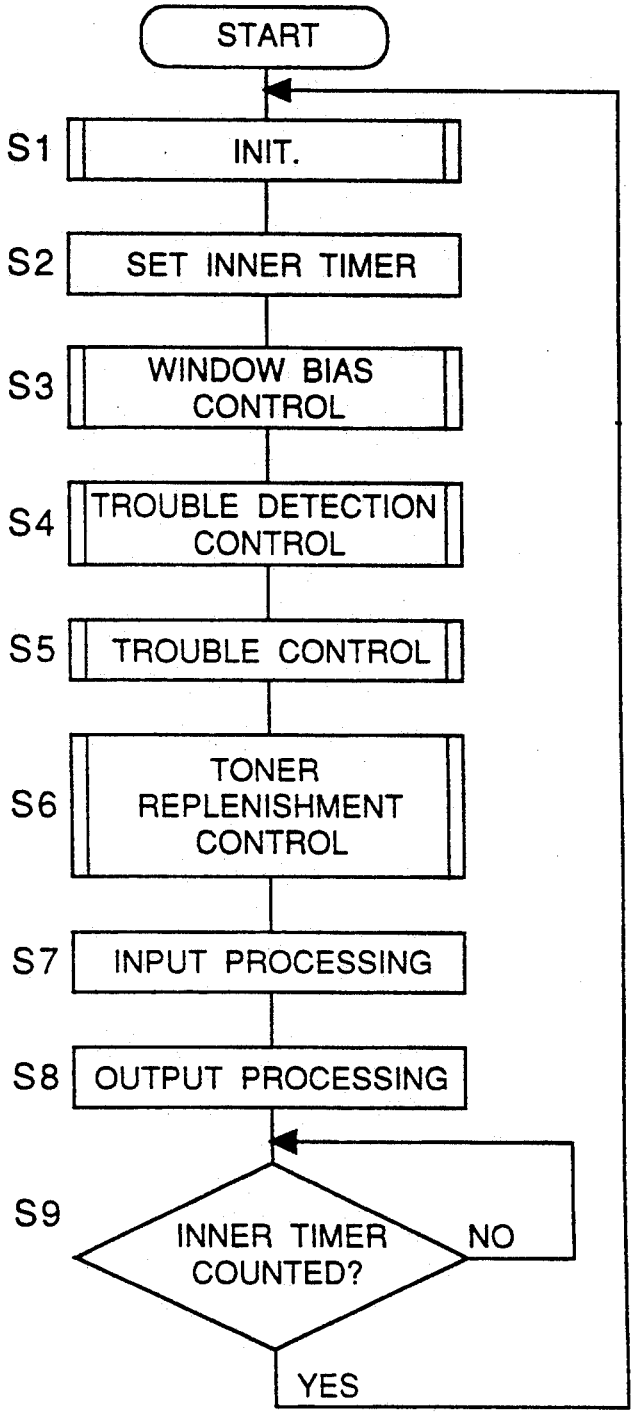
FIG. 8 is a flow-chart of a main routine of control in the development apparatus.

I. Main Routine (See, FIG. 8)

In a main routine, when a program starts by switching on the copying machine 1, at step S1, registers and peripheral interfaces are initialized.

At step S2, an inner timer for determining a time interval, of one routine is started. This time interval of one routine acts as a reference for each time counting carried out by various timers described below. A count number of each timer under controlling operation among the above-described various timers is updated in each passing of program flow through the main routine.

At step S3, window bias control, at step S4, trouble detection control, at step S5, trouble control, and at step S6, toner replenishment control are executed, respectively. These processings S3 to S6 are described below in detail. Subsequently, at step S7, input processing, and at step S8, output processing are executed. Further, at step S9, it is judged whether or not the counting executed by the inner timer has finished, and this judgement is repeated in the case of "NO", while in the case of "YES", step S1 follows, and thereafter above-described processings of steps S2 to S9 are repeated.

Figure 9:
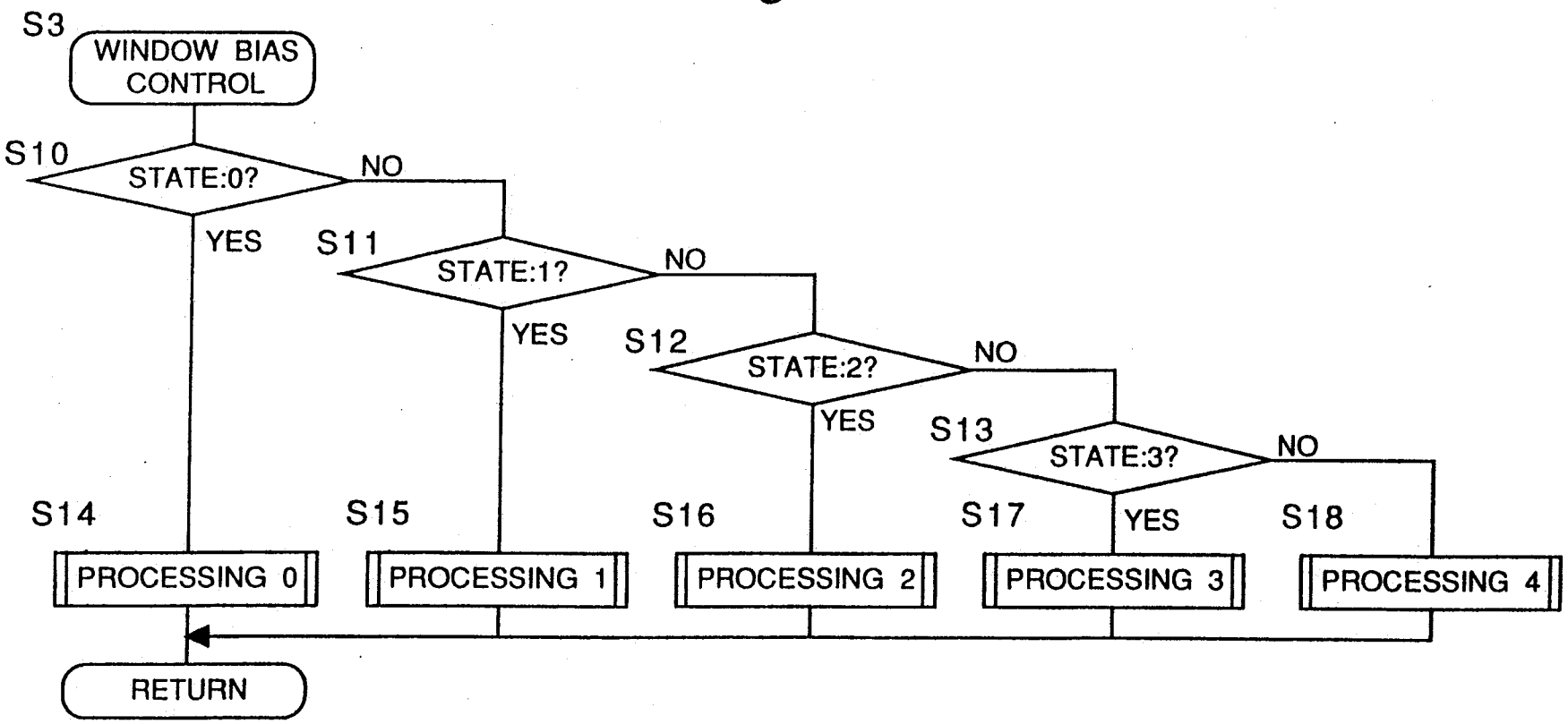
FIG. 9 is a flow-chart of window bias control in the development apparatus.

II. Window Bias Control (See, FIG. 9)

In the window bias control (step S3), at steps S10 to S13, it is judged whether or not a state numbers is set to anyone of "0" to "3", respectively. In the case of "YES" at steps S10 to S13, the program flow proceeds to anyone of bias processings "0" to "3" (steps S14 to S17), respectively. On the other hand, in the case of "NO" at steps S10 to S12, the program flow proceeds to step S11 or S12 or S13, and in the case of "NO" at step S13, the program flow proceeds to bias processing "4" (step S18).

Figure 10:
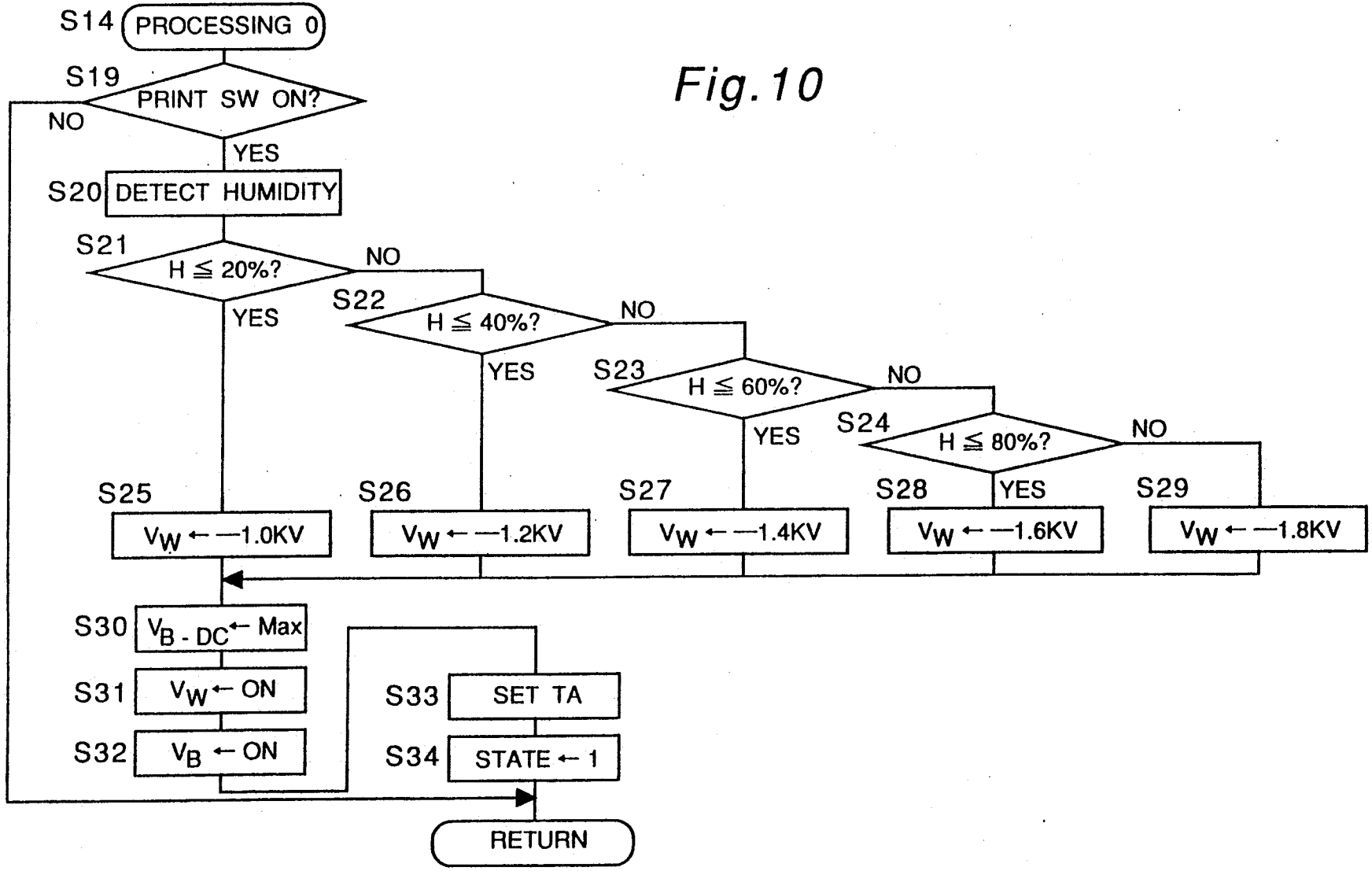
FIG. 10 is a flow-chart of bias processing 0 in the development apparatus.

Each of the bias processings "0" to "2" (steps S14 to S16) corresponds to a processing executed when the bias rises , while each of the bias processings "3" and "4" (steps S17 and S18) corresponds to a processing executed when the bias is turned off.

a. Bias Processing O (See, FIG. 10)

In the bias processing 0 (step S14), at step 19, it is judged whether or not the print switch 101 is turned on, namely ON edge of the print switch 101 is detected, and in the case of "YES", step S20 follows, while in the case of "NO", the program flow returns to the main routine.

Meanwhile, the ON edge means a state in which a signal is changed over from OFF to ON.

At step S20, humidity is detected based on an output signal from a humidity sensor 200.

At steps S21 to S24, it is judged whether or not the humidity is in any range of 0 to 20%, 20 to 40%, 40 to 60 %, or 60 to 80%, and in the case of "YES", at steps S25 to S29, a value of the window bias $V_W$ is determined according to the range, respectively.

More specifically, the window bias $V_W$ is set as follows:

if $H \leqq 20\%$, $V_W = -1.0$ KV,
if $20\% < H \leqq 40\%$, $V_W = -1.2$ KV,
if $40\% < H \leqq 60\%$, $V_W = -1.4$ KV,
if $60\% < H \leqq 80\%$, $V_W = -1.6$ KV and
if $80\% < H$, $V_W = -1.8$ KV.

Next, at step S30, the development bias $V_{B\text{-}DC}$ is set to maximum value.

At step S31, the window bias $V_W$ is output.

At step S32, the development bias $V_B$ is output.

At step S33, a timer TA for raising the bias is set.

At step S34, the state number is set to "1", thereafter the program flow returns to the main routine.

Figure 11:
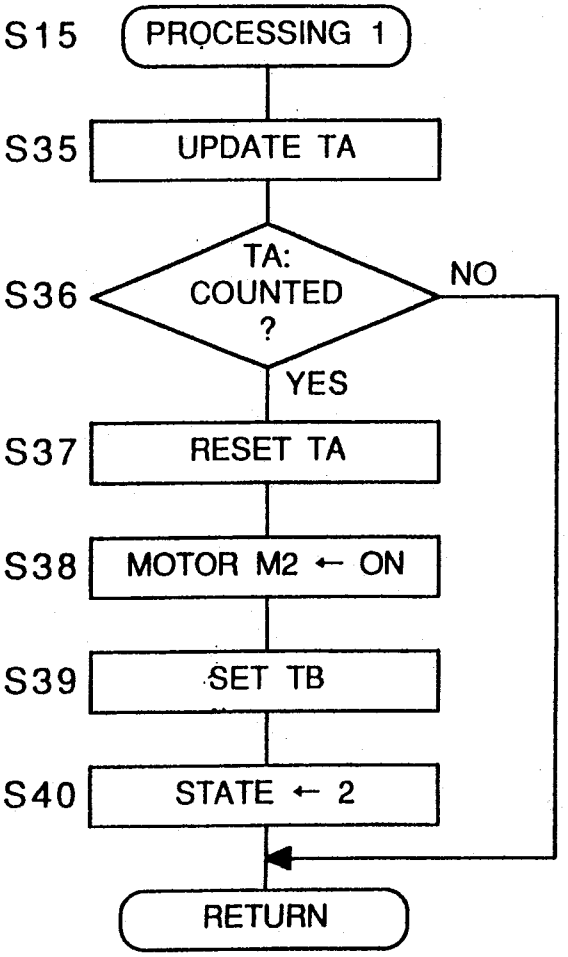
FIG. 11 is a flow-chart of bias processing 1 in the development apparatus.

The timer TA is provided to drive the agitator motor M2 under the condition that the window bias $V_W$ has raised completely for the following reason. If the developer is agitated by driving the motor M2 before the window bias $V_W$ rises sufficiently, agitated developer adheres to the detection window 54.

b. Bias Processing 1 (See, FIG. 11)

In the bias processing 1 (step S15), at step S35, a count number in the timer TA is updated.

At step S36, it is judged whether or not counting in the timer TA has finished, and in the case of "YES", step S37 follows, while in the case of "NO", the program flow returns to the main routine.

At step S37, the timer TA is reset.

At step S38, the agitator motor M2 is turned on. Thus, conveyance and agitation of the developer in the agitator passages 31 and 32 is started.

Next, at step S39, a timer TB for permitting to detect the toner density is set.

At step S40, the state number is set to "2", thereafter the program flow returns to the main routine.

Figure 12:
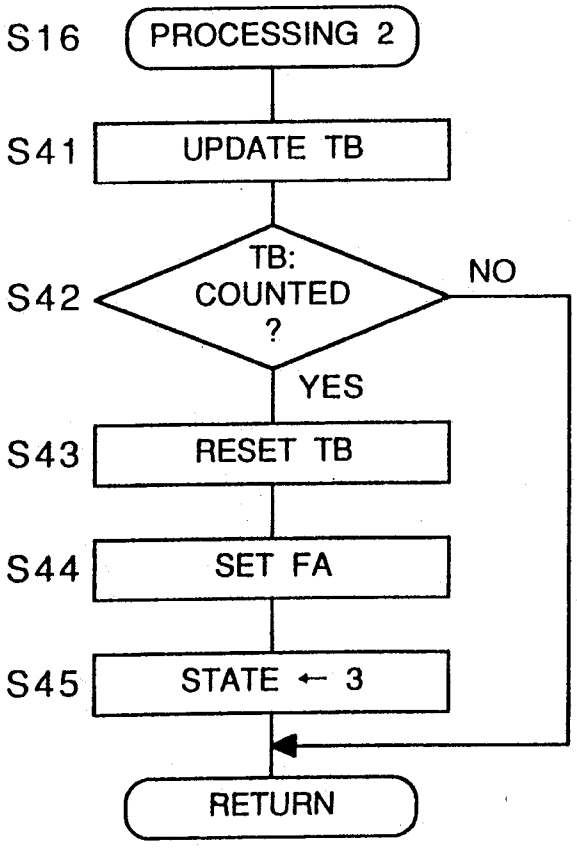
FIG. 12 is a flow-chart of bias processing 2 in the development apparatus.

The timer TB is set to a time period required for stabilizing the conveyance of the developer after the motor M2 is turned on.

c. Bias Processing 2 (See, FIG. 12)

In bias processing 2 (step S16), at step S41, a count number in the timer TB is updated.

At step S42, it is judged whether or not counting in the timer TB has finished, and in the case of "YES", step S43 follows, while in the case of "NO", the program flow returns to the main routine.

At step S43, the timer TB is reset.

At step S44, a flag FA for permitting to detect the toner density is set.

At step S45, the state number is set to "3", thereafter the program flow returns to the main routine.

Figure 13:
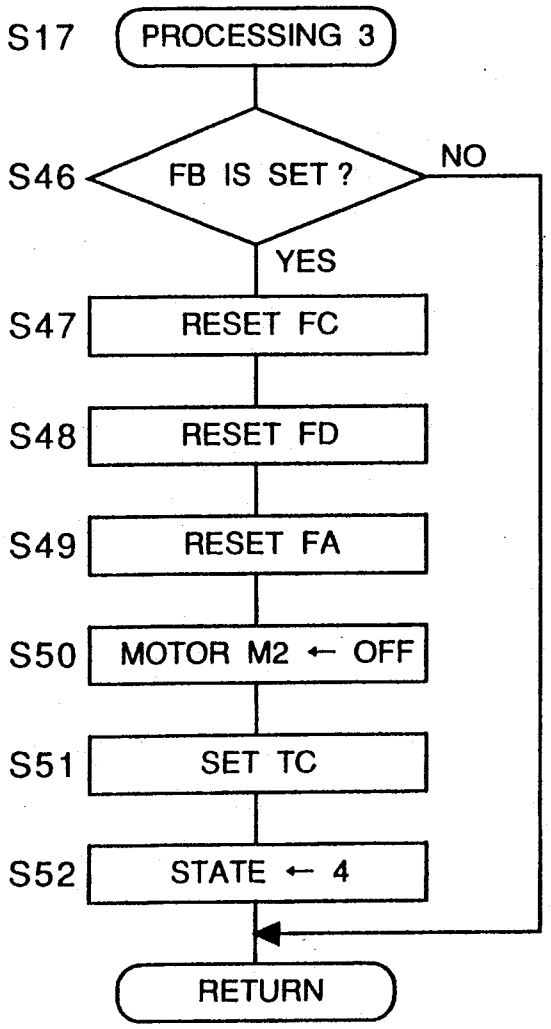
FIG. 13 is a flow-chart of bias processing 3 in the development apparatus.

By setting the flag FA, which is used for trouble detection control described below, it becomes possible to read an output from the detection sensor 50.

d. Bias Processing 3 (See, FIG. 13)

In the bias processing 3 (step S17), at step S46, it is judged whether or not a bias-off flag FB is set, and in the case of "YES", step S47 follows, while in the case of "NO", the program flow returns to the main routine.

The bias-off flag FB set in a sub-routine (not shown) is a flag for turning off the development bias $V_B$.

At step S47, a flag FC for density detection is reset. At step S48, a flag FD for replenishing the toner by fixed amount is reset.

At step S49, the flag FA is reset.

Meanwhile, the flag FC is set in a sub-routine for the trouble detection control, and the flag FD is set in a sub-routine for the trouble control.

Next, at step S50, the agitator motor M2 is turned off.

At step S51, a bias-off timer TC is set.

Figure 14:
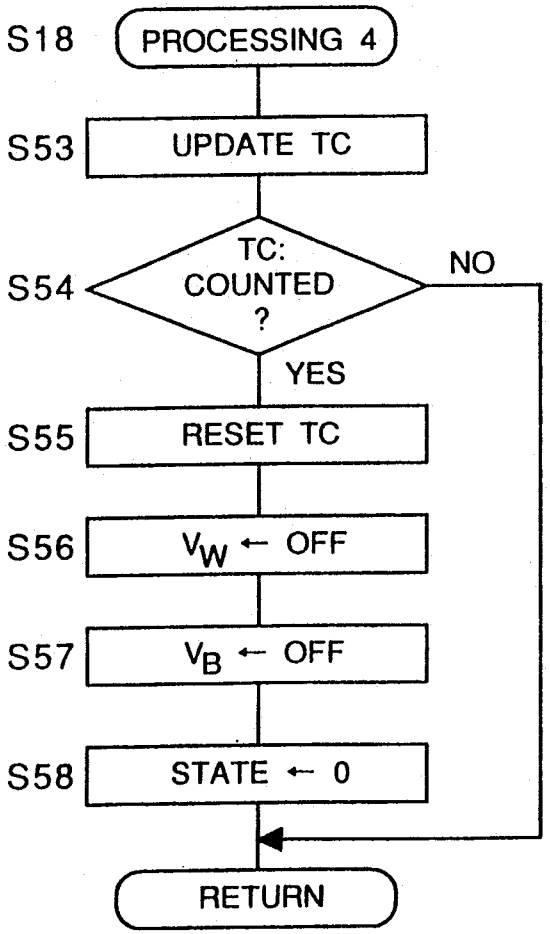
FIG. 14 is a flow-chart of bias processing 4 in the development apparatus.

At step S52, the state number is set to "4", thereafter the program flow returns to the main routine.

e. Bias Processing 4 (See, FIG. 14)

In the bias processing 4 (step S18), at step S53, a count number in the timer TC is updated.

At step S54, it is judged whether or not counting in the timer TC has finished, and in the case of "YES", step S55 follows, while in the case of "NO", the program flow returns to the main routine.

At step S55, the timer TC is reset.

At step S56, the window bias $V_W$, is turned off.

At step S57, the development bias $V_B$ is turned off.

At step S58, the state number is set to "0", thereafter the program flow returns to the main routine.

Meanwhile, off-timing of the window bias $V_W$ is delayed until the counting in the timer TC has finished, because the toner adhesion to the detection window 54 is caused by the rotation of the conveying screw 37 due to inertia of the motor M2, if the motor M2 and the window bias $V_W$ are turned off at the same time. Accordingly, a preset period of the timer TC is so determined as to exceed a duration from shut-off of supply of electric power to the agitation motor M2 to complete stop of the motor M2.

Figure 15:
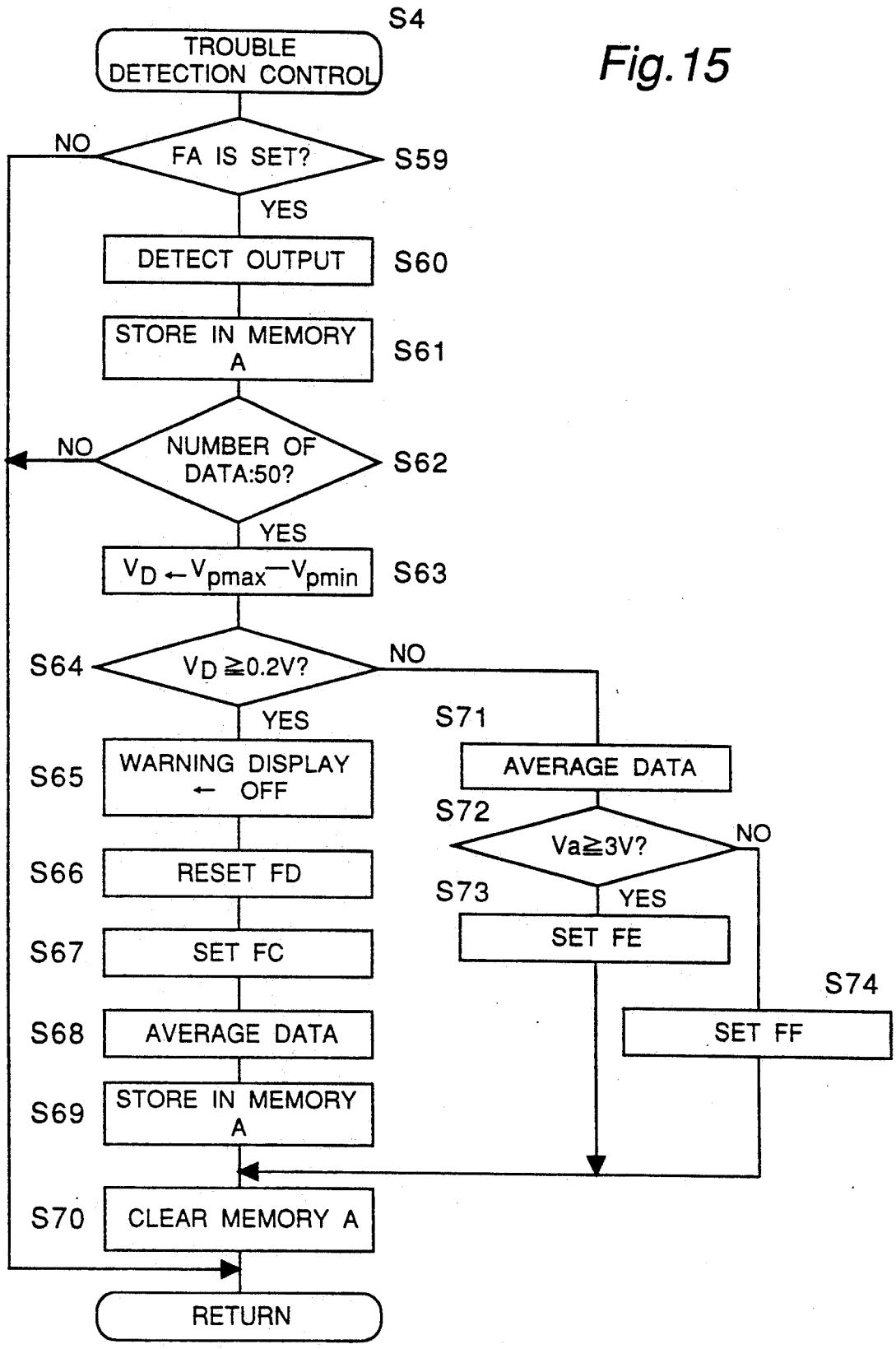
FIG. 15 is a flow-chart of trouble detection control in the development apparatus.

III. Trouble Detection Control (See, FIG. 15)

In the trouble detection control (step S4), presence or absence of adhesion of the toner or the carrier to the detection window 54 is detected based on a signal from the sensor 50.

Firstly, at step S59, it is judged whether or not the flag FA is set, and in the case of "YES", step S60 follows, while in the case of "NO", the program flow returns to the main routine. The flag FA is set at above-described step S44.

At step S60, output from the sensor 50 is subject to sampling.

At step S61, the sampling data is stored in a data memory A.

At step S62, it is judged whether or not number of sampling data attains to "50", and in the case of "YES", step S63 follows, while in the case of "NO", the program flow returns to the main routine. The data number "50" corresponds to a time period required for one rotation of the conveying screw 37 such that a maximum value and minimum value of output of the sensor 50 during a period allowing at least one rotation of the conveying screw 37 are adapted to be detected.

At step S63, a difference (magnitude of variation $V_D$) between the maximum value Vpmax and the minimum value Vpmin of the data is calculated.

At step S64, it is judged whether or not the magnitude of the variation $V_D$ is 0.2V or more, and in the case of "YES", step S65 follows, while in the case of "NO", step S71 follows. Meanwhile, the reason why the magnitude of the variation $V_D$ is detected is that the magnitude of the variation $V_D$ is affected by the toner adhesion and the carrier adhesion to the detection window 54. Namely, the magnitude of the variation $V_D$ becomes small with increase of the adhesion such that the amount of the reflected light converges on a constant value. Further, the reference voltage is set to 0.2V for the following reason. Namely, when the magnitude of the variation $V_D$ becomes smaller than 0.2V, normal toner density control on the basis of the detected toner density can not be performed anymore.

At step S65, a warning display (described below) is turned off.

At step S66, the flag FD is reset.

At step S67, the flag FC is set.

At step S68, the data in the data memory A are averaged.

At step S69, the average data is stored in a memory B.

At step S70, the data in the data memory A are cleared, thereafter the program flow returns to the main routine.

On the other hand, in the case that the magnitude of the variation $V_D$ is smaller than 0.2V ($V_D<0.2V$), at step S71, the data in the data memory A are averaged.

At step S72, it is judged whether or not the average voltage Va is 3.0V or more, and in the case of "YES", step S73 follows, while in the case of "NO", step S74 follows. Meanwhile, the judgment on whether or not the average voltage is 3.0V or more is performed for purpose of deciding if the toner or the carrier adheres to the detection window 54. Namely, if the toner adheres to the detection window 54, the amount of the reflected light received by the light receiving element 53 increases, and the output from the sensor 50 becomes high, because the toner (especially, the toner made from pigment adjusted to full-color copying machine) reflects a light (infrared light) emitted from light emitting element 52. On the contrary, if the carrier adheres to the detection window 54, the amount of the received light decreases, and the output from the sensor 50 becomes low, because the carrier absorbs the light emitted from the light emitting element 52. Thus, it is possible to judge that the toner adhesion occurs, if the average voltage Va is high, while the carrier adhesion occurs, if the average voltage Va is low. Further, in the case that no adhesion occurs on the detection window 54, the toner and carrier are in contact with the detection window 54 in mixed state each other, and emitted light from the light emitting element 52 indicates intermediate value of each adhesion state described above, according to a mixture ratio of the toner and carrier. Therefore, a mixture ratio of the toner and the carrier can be detected based on the output from the sensor 50. Meanwhile, the reason why the reference voltage is determined to 3.0V is that in the development apparatus according to this embodiment, the output from the sensor 50 becomes to 3.0V, when neither the toner nor the carrier adheres to the detection window 54.

Next, at step S73, namely if $Va<3.0V$, a flag FE for showing an occurrence of toner adhesion trouble is set.

While, at step S74, namely if $Va\geqq 3.0V$, a flag FF for showing an occurrence of carrier adhesion trouble is set.

At step S70, the data in the data memory A are cleared, thereafter the program flow returns to the main routine, as mentioned above.

Figure 16:
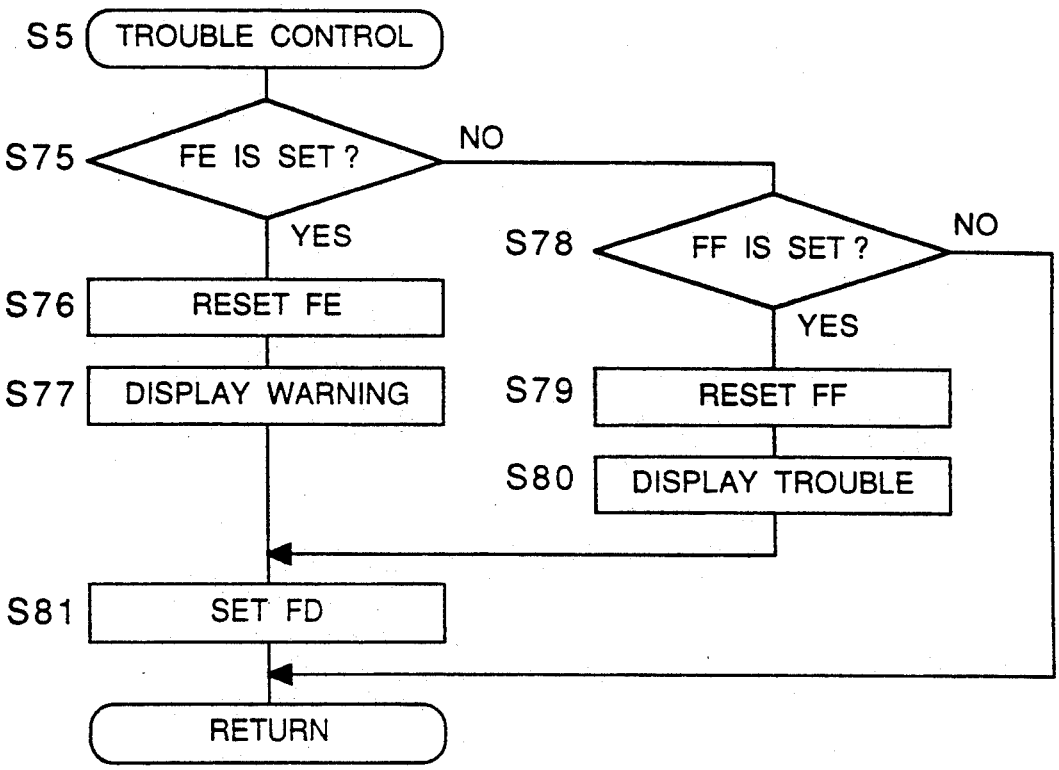
FIG. 16 is a flow-chart of trouble control in the development apparatus.

IV. Trouble Control (See, FIG. 16)

In the trouble control (step S5), at step S75, it is judged whether or not the flag FE is set, and in the case of "YES", step S76 follows, while in the case of "NO", step S78 follows.

At step S76, the flag FE is reset.

At step S77, a LED 102 on the operation panel 100 for a warning display of the toner adhesion blinks to warn that the toner adhesion to the detection window 54 occurs.

On the other hand, if the flag FE is not set, at step S78, it is judged whether or not the flag FF is set, and in the case of "YES", step S79 follows, while in the case of "NO", the program flow returns to the main routine.

At step S79, the flag FF is reset.

At step S80, a LED 103 on the operation panel 100 for a warning display of the carrier adhesion blinks to warn that the carrier adhesion to the detection window 54 occurs.

Since correct toner density can not be detected when the toner adhesion or the carrier adhesion to the detection window 54 occurs, at step S81, the flag FD is set such that the toner in an amount corresponding to a number of copies is replenished on the basis of a predetermined amount of toner consumed usually for one copy.

As mentioned above, if neither the flag FE nor the flag FF is set (steps S75 and S78), the program flow returns to the main routine, since neither the toner nor the carrier adheres to the detection window 54, so that the detection of the toner density is performed accurately.

Figure 17:
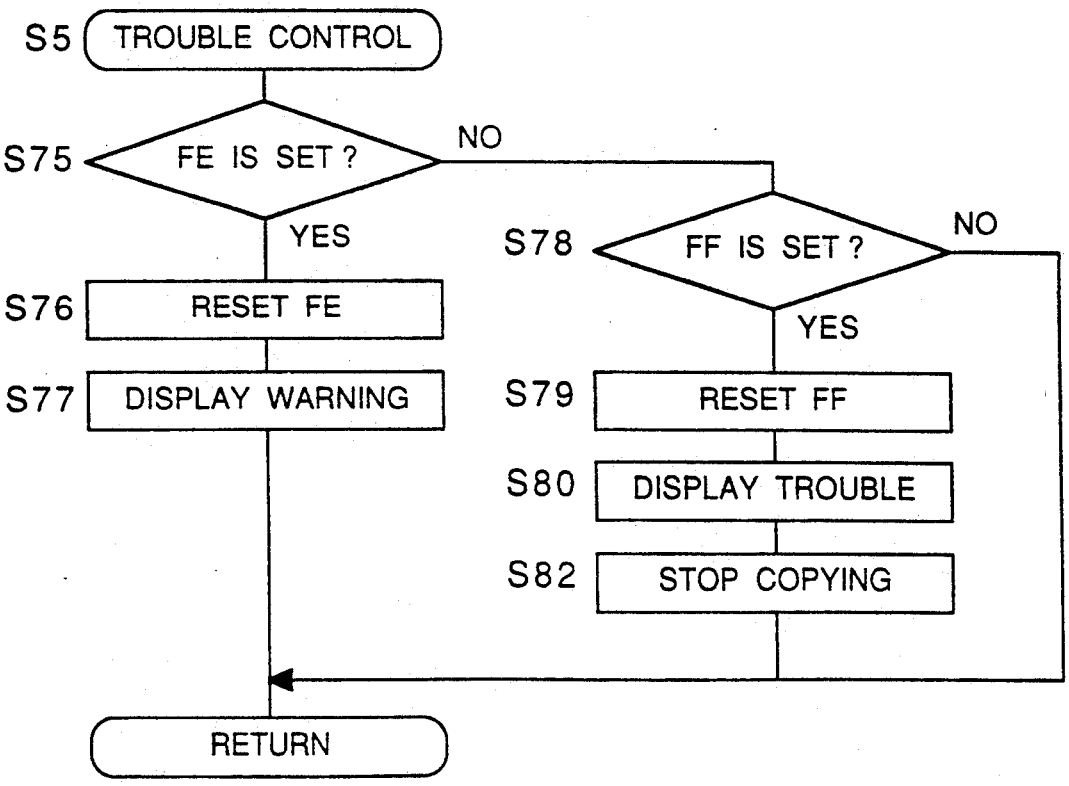
FIG. 17 is a flow-chart of another trouble control in the development apparatus.

When the toner or the carrier has adhered to the detection window 54 as described above, toner replenishment is changed over to fixed amount replenishment in which a fixed amount of the toner is replenished for each of copies to be taken. However, as shown in FIG. 17, when the toner adhesion occurs, only the LED 102 may blink at step S77, and when the carrier adhesion occurs, only the drive of the copying machine may be stopped at step S82. When the carrier adhesion occurs, the copying machine 1 is stopped for the following reason. Namely, in this case, the toner density is judged to be low due to drop of the output from the sensor 50, thereby resulting in an overflow of the toner due to the replenishment of unnecessary toner. Even if the toner adhesion occurs, only warning is issued for the following reason. Namely, in this case, the image density merely drops due to stop of replenishment of the toner and such a problem as contamination of interior of the copying machine 1 with the toner does not arise.

Figure 18:
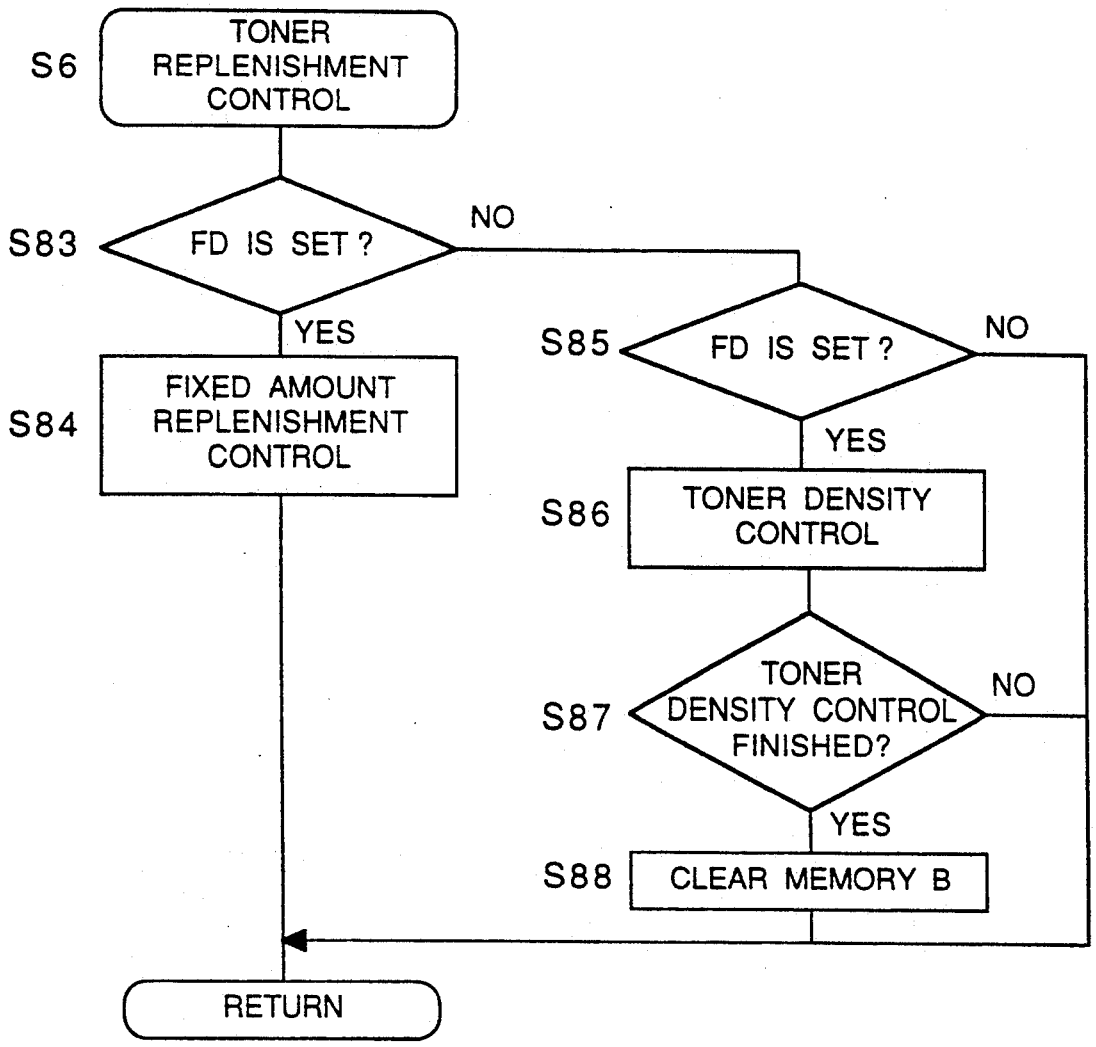
FIG. 18 is a flow-chart of toner replenishment control in the development apparatus.

V. Toner Replenishment Control (See, FIG. 18)

In the toner replenishment control (step S6), at step S83, it is judged whether or not the flag FD is set, and in the case of "YES", step S84 follows, while in the case of "NO", step S85 follows.

At step S84, control for replenishing the toner by fixed amount is executed.

While, at step S85, it is judged whether or not the flag FC is set, and in the case of "YES", step S86 follows, while in the case of "NO", the program flow returns to the main routine.

At step S86, toner density control is executed. Namely, the replenishment of the toner is performed corresponding to detected toner density.

At step S87, it is judged whether or not the toner density control has finished, and in the case of "YES", step S88 follows, while in the case of "NO", the program flow returns to the main routine.

At step S88, the data in the memory B is cleared, thereafter the program flow returns to the main routine.

Figure 19:
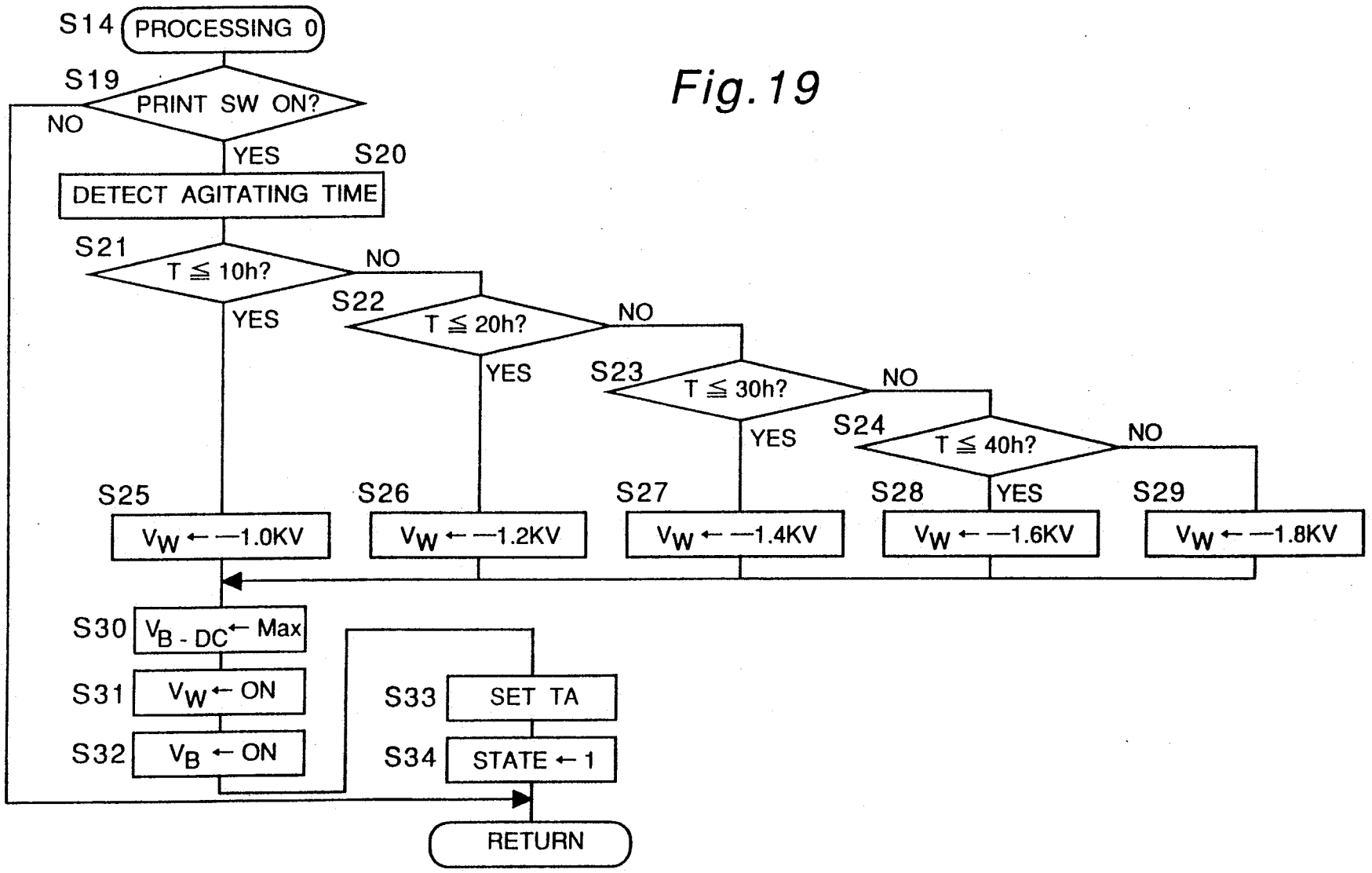
FIG. 19 is a flow-chart of another bias processing 0 in the development apparatus.
Figure 20:
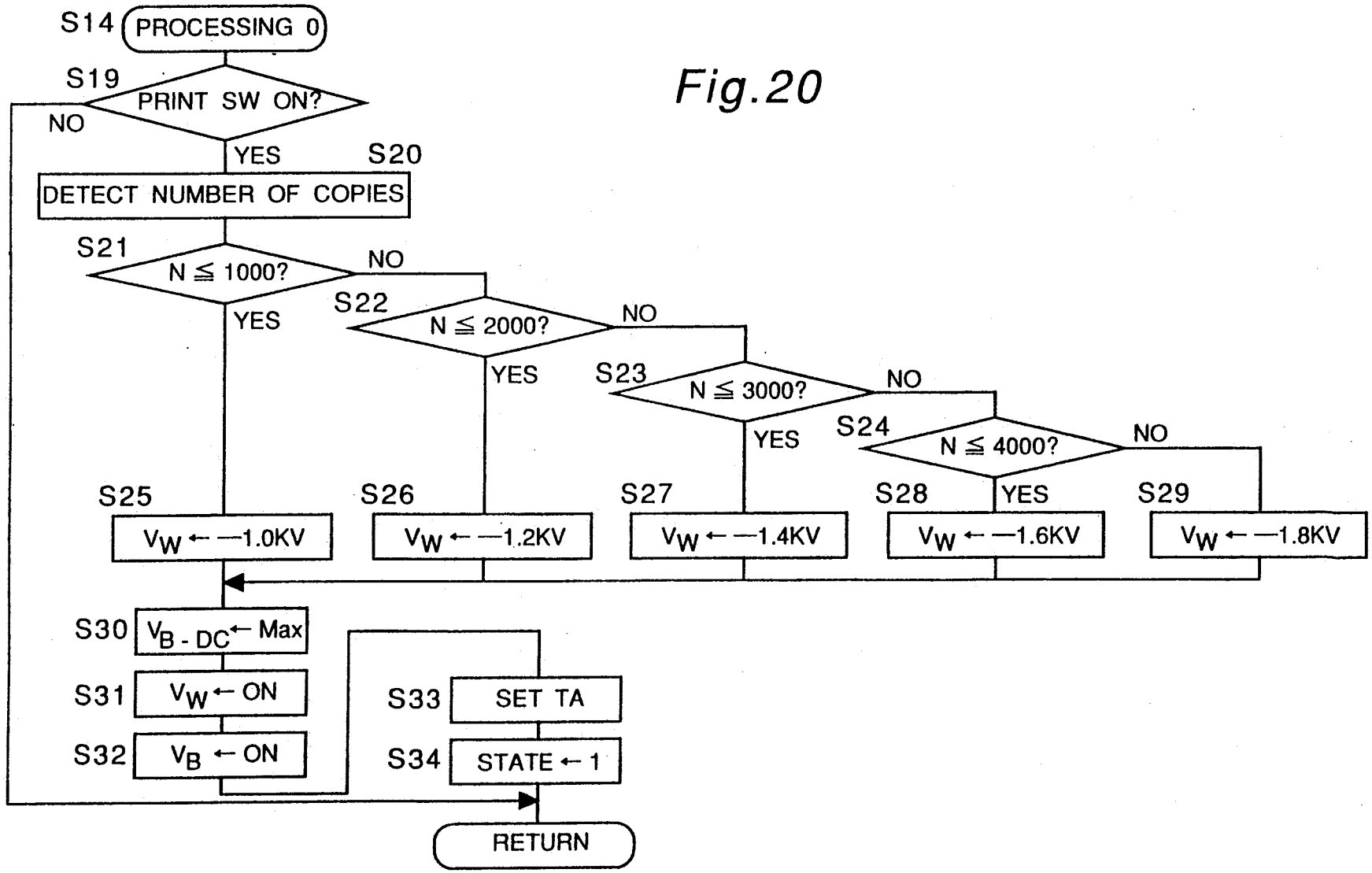
FIG. 20 is a flow-chart of further bias processing 0 in the development apparatus.

In the above description, the window bias $V_W$, is determined based on the data obtained through the humidity sensor 200. However, charging property of the developer varies depending on agitation period of the developer. Namely, the charging property becomes weak as the agitation period becomes long. Therefore, as shown in FIG. 19, the window bias $V_W$ may be determined in a following way. Namely, at step S20, a length T of the agitation period is detected, thereafter, at steps S21 to S29, the window bias $V_W$ is determined according to the agitation period T. Meanwhile, the agitation period of the developer can be derived by making timers provided in each development apparatuses start counting when new developer is supplied to each development apparatus, and by storing the count number counted by each timer. Further, since there is a certain relation between the agitation period and number of printed sheets, the window bias $V_W$ may be determined, as shown in FIG. 20, according to count number counted for the printed sheets at the development apparatus after new developer is supplied to the development apparatus.

As will be apparent from the description given so far, the following effects can be obtained by the method and the apparatus for optically measuring toner density according to the present invention.

Namely, the occurrence of abnormality on the detection window is recognized and warned when the magnitude of the variation of amount of the reflected light becomes small due to the occurrence of the toner adhesion or the carrier adhesion to the detection window.

Therefore, the occurrence of the toner adhesion or the carrier adhesion to the detection window can be recognized, thereby toner density control is not be performed under such an abnormal condition. In other words, so far as the abnormality is not recognized, both the toner adhesion and the carrier adhesion do not occur, so that it becomes possible to detect correct toner density and to perform the toner density control corresponding to correct toner density.

Further, under a condition that the carrier is apt to adhere to the detection window due to increase of the charging amount of the developer caused by drop of humidity or supply of fresh developer to the development apparatus, electrical suction force between the carrier and the detection window becomes weak and thus, the carrier adhesion to the detection window is avoided.

On the other hand, under a condition-that toner in suspension is apt to be produced due to decrease of the charging amount of the developer caused by rise of the humidity or deterioration of the developer, the window bias rises and therefore, the adhesion of the suspended toner to the detection window is avoided.

Namely, in accordance with the present invention, since the window bias is adjusted based on charging conditions of the developer, the toner adhesion and the carrier adhesion to the detection window are prevented, so that toner density can be detected accurately at all times.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. A method for optically measuring toner density in two-component developer, comprising the steps of:

causing said developer constrained by a magnetic field to be brought periodically into contact with a transparent detection window;

illuminating said developer through said detection window;

measuring said toner density on the basis of an amount of reflected light from said developer; and recognizing and warning of the occurrence of abnormality of the developer on said detection window when a magnitude of variation of an amount of said reflected light becomes smaller than a predetermined reference value.

2. An apparatus for optically measuring toner density, comprising:

a rotary member which rotates and retains a developer constituted by a toner and a carrier by magnetic force;

a transparent detection window which is disposed at a position where said developer retained on said rotary member rubs said detection window through rotation of said rotary member;

a detection means which illuminates said developer through said detection window and detects an amount of reflected light from said developer and detects a magnitude of variation of said amount of reflected light in response to rotation of said rotary member; and a warning means which issues an abnormal warning when said magnitude is smaller than a predetermined reference value.

3. An apparatus as claimed in claim 2, wherein said detection window is electrically conductive, and is applied with a bias voltage electrically repulsive to said toner.

4. An apparatus as claimed in claim 2, wherein said warning means includes a display means, and is disposed on an operation panel.

5. An apparatus as claimed in claim 3, wherein said bias voltage varies with a variation of humidity.

6. An apparatus as claimed in claim 3, wherein said bias voltage varies with deterioration degree of said developer.

7. An apparatus as claimed in claim 2, further comprising judging means for judging which of the toner or the carrier adheres to said detection window according to the amount of said reflected light from said developer, when said warning means issues an abnormal warning.

8. An apparatus as claimed in claim 7, wherein said judging means judges that the toner adheres to said detection window in case that said amount of said reflected light becomes higher than a predetermined value.

9. An apparatus as claimed in claim 7, wherein said judging means judges that carrier adheres to said detection window in case that said amount of said reflected light becomes lower than said predetermined value.

10. An apparatus as claimed in claim 2, further comprising toner replenishing means for replenishing the toner to the developer based on a toner density when said warning means does not issue an abnormal warning, and for replenishing a fixed amount of toner when said warning means issues an abnormal warning.

11. An apparatus as claimed in claim 7, further comprising display means for providing an abnormal warning on an operation panel when said judging means judges that the toner adheres to said detection window.

12. An apparatus as claimed in claim 7 wherein said apparatus is in a copying machine, and further comprising stopping means for stopping a drive of the copying machine when said judging means judges that the carrier adheres to said detection window.

* * * * *